US006347404B1

(12) United States Patent
Iskra

(10) Patent No.: US 6,347,404 B1
(45) Date of Patent: Feb. 19, 2002

(54) CEMENT FINISHING BOARD HAVING A FLOATING KNEE HOLDER

(76) Inventor: Tony Iskra, 17046 Rock Creek Rd., Thompson, OH (US) 44086-8758

( * ) Notice: Subject to any disclaimer, the term of this patent is extended or adjusted under 35 U.S.C. 154(b) by 0 days.

(21) Appl. No.: 09/723,982

(22) Filed: Nov. 28, 2000

(51) Int. Cl.[7] ..... F04G 1/00
(52) U.S. Cl. ..... 2/24; 182/230
(58) Field of Search ..... 2/24, 22, 911, 2/16, 455, 62; 182/230; 297/423.1; 248/346.01; 36/113, 116

(56) References Cited

U.S. PATENT DOCUMENTS 2,195,817 A * 4/1940 Johnson ..... 2/24
2,627,301 A * 2/1953 Emmett ..... 182/230
2,719,576 A * 10/1955 Emmett ..... 182/230
3,112,812 A * 12/1963 Ramon ..... 182/230
3,499,502 A * 3/1970 Rosander ..... 182/230
4,346,784 A * 8/1982 Hammond ..... 182/230
4,747,470 A * 5/1988 Fernandez ..... 182/230
4,789,046 A * 12/1988 McDowall ..... 182/230
5,125,479 A * 6/1992 Nemes et al. ..... 182/230

* cited by examiner

*Primary Examiner*—John J. Calvert
*Assistant Examiner*—Tejash Patel
(74) *Attorney, Agent, or Firm*—Vytas R. Matas

(57) ABSTRACT

The present invention is drawn to a cement finishing board providing a cushioned knee support mounted on a non-cement adhering solid plastic material board which supports the knee in a contoured cushion knee pad air suspended above the board to allow the pad freedom of movement in both the x and y directions. The pad is also angled to provide an ergonomic knee support wherein the shin support pad is angled along the shin angle of the leg when the finisher is kneeling on the board and an adjustable toehold is provided to compensate for different leg lengths.

12 Claims, 2 Drawing Sheets

CEMENT FINISHING BOARD HAVING A FLOATING KNEE HOLDER

BACKGROUND OF THE INVENTION

1. Field of the Invention

The present invention is generally drawn to cement finishing boards and more particularly to such boards, which are relatively free of cement adherence to the board and having a soft knee holder on each board.

2. Description of the Prior Art

In the construction industry, concrete slabs are commonly finished by hand troweling. The work is usually done by assuming a full kneeling position and using one or two hand trowels as the workman moves rearward across the surface of the uncured cement surface. Working under these conditions requires some form of protection for the workman's knees both in terms of support on the surface of the soft concrete and from the standpoint of cushioning or easing the pressure on the workman's knees over sustained periods of time since big cement jobs may be as large as a football field. In addition, the support apparatus or board holding the knee support must also be such as to avoid as much damage as possible to the soft surface of the uncured cement as the finisher moves along the cement. This damage usually comes from cement adherence to the board. Two different types of concrete are used for indoor and outdoor finishing namely non air-entrained and air-entrained concrete respectively. The aerated outdoor concrete is relatively free of adherence to the different types of finishing boards other than wood while the indoor concrete is especially adherent to wood, metal and even some plastic boards. U.S. Pat. No. 4,789,046 teaches one type of less adherent board which is formed as a single board made of polyurethane foam and having a smooth plastic cover there over. There is a loop at the end of the board, but it is used for carrying the board rather than as a toehold. There are no kneepads and the finisher places both legs on the single board and moves along the cement on the single board. This coating while being somewhat slippery and non-adherent to cement quickly wears out and is subject to damage from the concrete surface. A strong one-piece board material, which minimizes concrete adherence thereto for both air entrained and non air entrained concrete, was not found in the prior art and was greatly needed.

Since a lot of time is spent by cement finishers on their knees in finishing the cement, a soft knee support is vital to prevent fatigue and knee damage. Soft kneepads mounted thereto are known methods of providing such soft knee support. Attempts have been made to combine the soft cushion type knee protectors with hard surface flotation boards made of wood, stainless steel and plastic, which accommodate both the knee and the toe of each individual leg of the user. U.S. Pat. No. Des. 353,702 teach a kneepad mounted on individual boards with the two boards connected by a couple of rods and having rollers for easily moving along a surface. However, these kneepads are directly mounted to the board surface and do not provide sufficient soft support for the knee. Also, the boards being tied together prevent the individual knee motion required for cement finishing and the rollers would score the unfinished cement instead of floating thereon.

A careful review of the above patent reference thus shows that while it is known to use some type of smooth plastic board for retaining a cement finishers knees and toes thereon to easily move along a cement surface there is no teaching of a particular type of board material which is non-adherent to both air-entrained and non air entrained cement. Also, while it is known to place kneepads and toe supports on finishing boards for retaining legs and toes thereon, there is no teaching of splitting a cement finishing board into two independent boards made from such non-adhering material and with each having an air mounted kneepad and an elevated loop for positively retaining a knee and toe on each of such boards.

In view of the foregoing it is seen that what was needed was a flexible knee support mounted on a non-cement adhering board which would support the knee in a contoured cushion air suspended from the board to allow the cushion freedom of movement in both the x and y directions and not being subject to the hard resistance abrasions from mounting the soft knee support directly to the hard surface board.

SUMMARY OF THE INVENTION

The present invention solves the problems associated with prior art cement finishing boards and others by providing a cushioned knee support mounted on a non-cement adhering solid board which supports the knee in a contoured cushion air suspended above the board to allow the cushion freedom of movement in both the x and y directions and providing a soft knee support. This is done by providing a pair of angled support members spacedly extending up from the board and having a strong canvas cloth affixed across these two members to cover the space there between. The cushioned knee support is affixed to the canvas cover to allow two degrees of movement to the cushion while being suspended from the board to provide a flexible air cushioned knee support which moves with the direction of knee movement. The angle of the supports is made to match the angle of the shin as the cement finisher kneels on the board cushions to relieve any strain to the leg.

Located at the other end of the board is an adjustable toe support, which comprises a loop member elevated from the face of the board and being sufficiently large to allow a work shoe having rubber boots thereon to fit therein. The toe support assembly is made adjustable to allow the toe support to be moved forward or back to match the leg length of the finisher. The toe holder is also sufficiently elevated from the board surface to allow the toe of the finisher to fit hereunder to allow an upright walk from the cement surface by the finisher using the board as a snowshoe.

In view of the foregoing it is seen that one aspect of the present invention is to provide a solid cement finishers board made from non-cement adhering material, which is non-adhering to both air-entrained and non air-entrained cement.

Another aspect of the present invention is to provide a cement finishers board having an air suspended knee cushion support not in direct contact with the board.

Yet another aspect of the present invention is to provide a cement finishers board having the knee cushion support angled at the shin angle of the leg when the finisher is kneeling on the board.

Still yet another aspect of the present invention is to provide a cement finishers board having an elevated looped toe holder at the end of the board for allowing the toes of the finisher to fit hereunder to allow an upright walk by the finisher with the board on his toe.

Still yet another aspect of the present invention is to provide a cement finishers board having an adjustable toe holder at the end of the board for accommodating different leg shin lengths.

Still yet another aspect of the present invention is to provide a cement finishers board having an adjustable toe holder at the end of the board with a loop toe holder fitting a work shoe with a rubber boot thereon.

These and other aspects of the present invention will be more fully understood upon a review of the following description of the preferred embodiment when considered with the accompanying drawings.

DESCRIPTION OF THE PREFERRED EMBODIMENT

Figure 1:
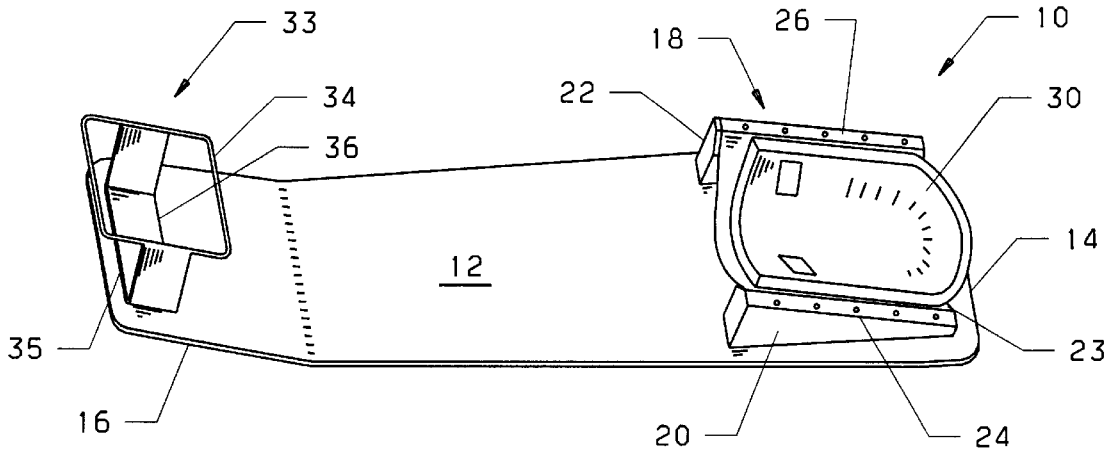
FIG. 1 is a perspective view of the cement finishing board of the present invention.
Figure 2:
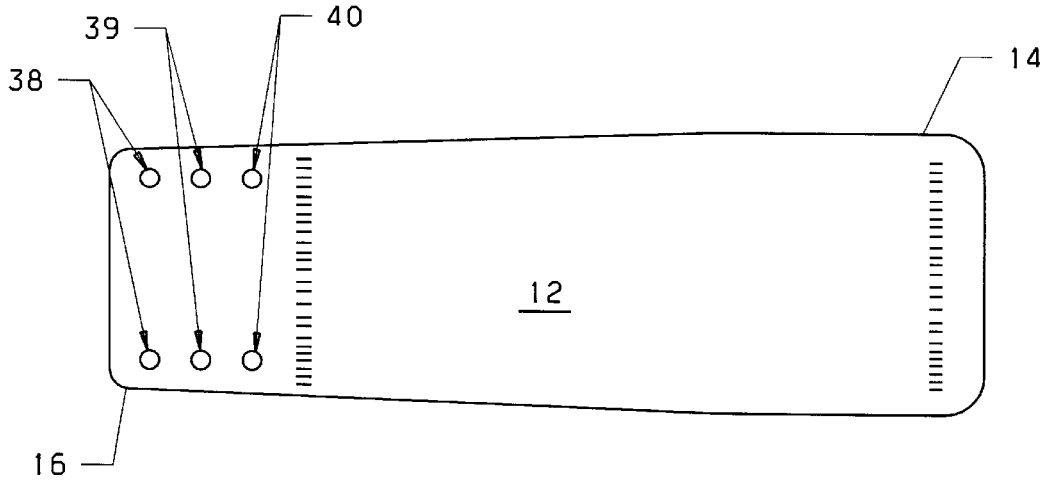
FIG. 2 is atop view of the board of FIG. 1.

Referring now to the drawings generally and to FIG. 1 in particular, a single cement finishing board assembly (10) is shown but it will be understood that two such boards are used by cement finishers and the second board is similar to the first. The board assembly comprises an acrylic solid plastic board (12) approximately ½ inch thick and having a slightly angled up front section (14) and an angled up back section (16). The front section is approximately 1 inch long and is angled up approximately 30 degrees. The back section is approximately 6 inches long and is angled up approximately 15 degrees. These angled front and back sections allow the finisher to move back and forth along the cement without scoring it. Clearly different lengths and angles would work. The acrylic material was found to be non-adherent to cement which was both air entrained and non air-entrained. Lexan plastic material was also found to have the same non-adherent properties but is presently more expensive.

Figure 3:
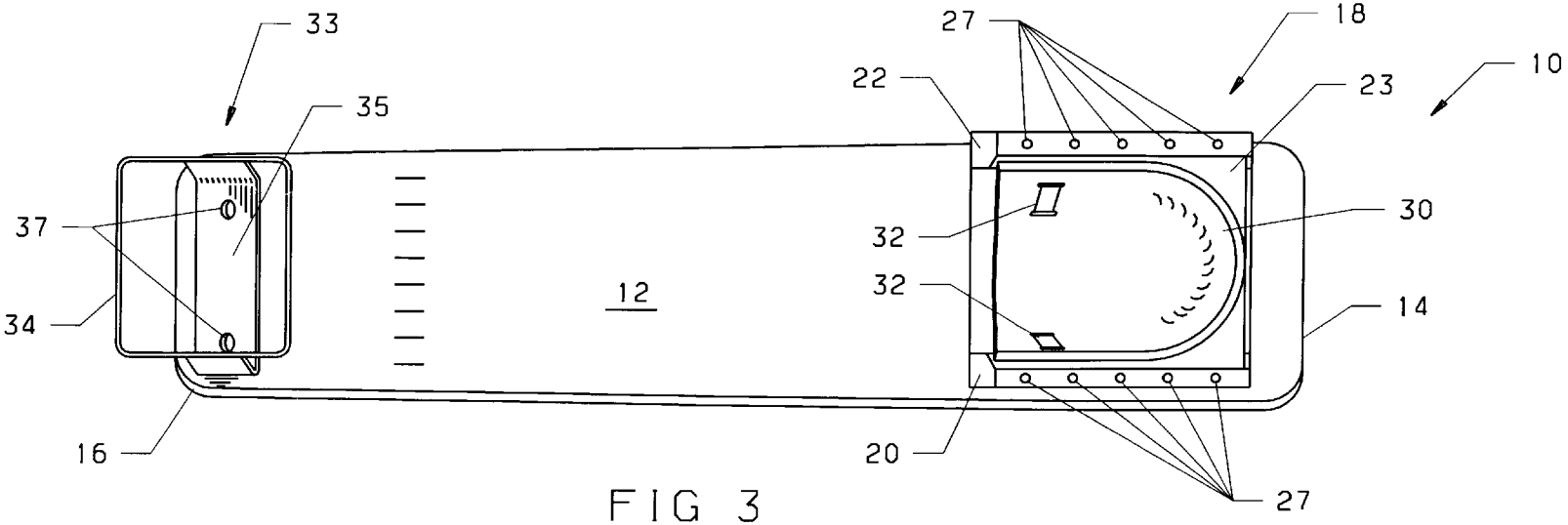
FIG. 3 is a side view of the FIG. 1 board.
Figure 4:
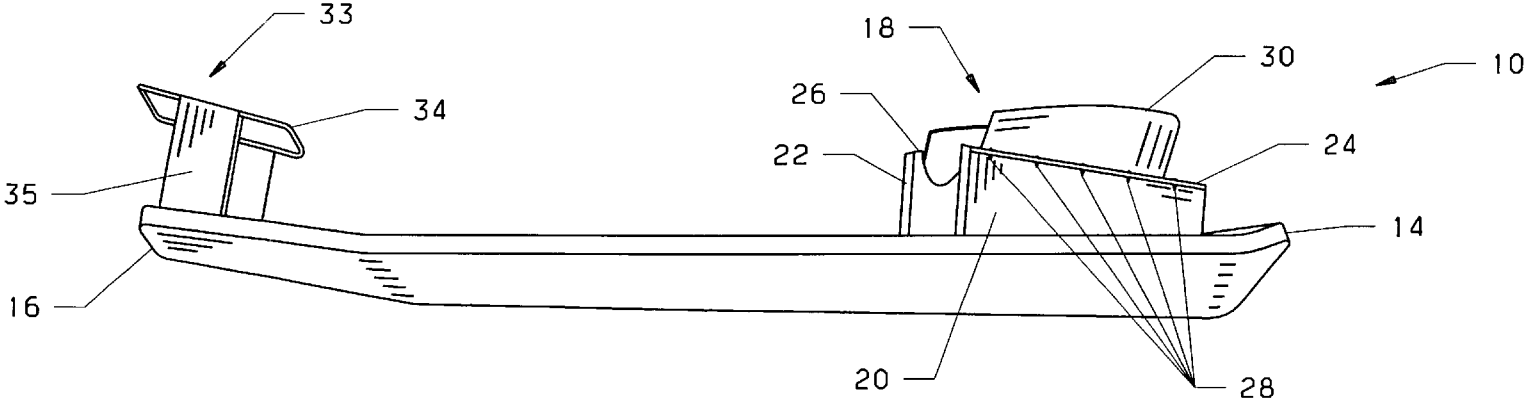
FIG. 4 is a bottom view of the FIG. 1 board.

Located at the front of the board assembly (10) is a knee support assembly (18), which allows the knee to be suspended in air up from the hard board (12) surface. This prevents the knee from bruising contact with the board and from getting wet from any wet cement that may get on the board (12) surface to wet the knee or kneepad as in prior art boards. To accomplish this end, the assembly (18) uses a pair of angled wedge sections (20,22), which are glued, to the straight section of the board (12) proximate to the angled front section (14). The glue used is a solvent type cement or acrylic glue, which in effect melts the contacting acrylic surfaces together into a single unit. The gluing was preferable to any type of mechanical joint, which could cause a galling of the cement surface when the bottom of the board wears down to the joining screws or other mechanical joining means. A canvas sheet (23) is attached across the top surfaces (24,26) of the wedge sections (20,22) by screwing eight grommets (27) formed at each end of the canvas (23) into the top sections (24,26 ) of the wedge sections (22,24) by screws (28). The canvas section (23) is thus loosely held above the board (10). A soft formed knee pad (30) is fastened to the canvas section (23) by a strap (31) which extends through adjoining holes (32) formed in the canvas section (23) and the knee pad (30) as best seen in FIGS. 3 and 4 where the one wedge section is shown as being transparent to show the strap buckling the knee pad (30) to the bottom of the canvas section (23). This allows the knee to move in both the x and y direction along the board (10) while being suspended in air above it. It should also be noted that the wedge sections (20, 22) are angled toward the front of the board (10) to allow the knee to sit in the knee pad (30) at the same angle as the shin of the leg. This ergonomic design prevents fatigue and cramping of the leg muscles during extended work periods.

Formed at the back of the board (10) is a toehold assembly (33) located along the angled back section (16) of the board (10). The toehold assembly (33) comprises a loop (34) elevated above the board section (16) by a U-shaped support plate (35). The loop (34) is large enough to hold the toe of a work shoe having a rubber boot thereon and is welded to the open top of the plate (35) while the bottom section (36) is fastened to the board section (16) by a pair of recessed nut and bolt assemblies (37) extending through one pair of three pairs of holes ( 38,39.40) formed in the board section (16). These holes allow the adjustment of the distance between the toe and the knee of the finisher to match his leg length to provide a good slip free mount of the finishers leg on the board (10).

The toe hold loop (34) is elevated from the board (10) to allow the finisher to place his toe under the loop (34) when he is in the upright position to allow him to walk across the cement in the upright position using the boards as snow-shoes or to glide there along in a manner similar to the use of skies in cross-country skiing.

It will be understood that certain details and improvements have been deleted herein for the sake of conciseness and readability but are intended to fall within the scope of the following claims.

What is claimed is:

1. A cement finishing board for use by cement finishers comprising:

a solid plastic board of non-cement adhering material;

a knee support assembly located at one end of said board for supporting the knee of a cement finisher in a canvas like material suspended in air between a pair of supports to hold the material above said board; and a toehold located at an opposite end of said board.

2. A board as set forth in claim 1 wherein said support assembly is angled to the shin angle of a cement finisher.

3. A board as set forth in claim 2 wherein said toehold includes adjustment means to compensate for the leg length of a cement finisher.

4. A board as set forth in claim 3 wherein said adjustment means includes a series of apertures located at one end of said board for mounting said toehold in a series of distances from said knee support assembly.

5. A board as set forth in claim 4 wherein said toehold includes a loop mounted at one end of a u-shaped bracket with the other end of said bracket being mounted to one of said series of apertures.

6. A board as set forth in claim 1 wherein said knee support assembly includes a soft knee pad mounted to the canvas sheet suspended above said board by the support sections mounted to said board.

7. A board as set forth in claim 6 wherein said support sections comprise a pair of wedge sections formed at an angle approximating the shin angle of of the cement finisher.

8. A board as set forth in claim 7 wherein said wedge sections are formed from the same plastic material as said board and are glued to said board.

9. A board as set forth in claim 8 wherein said canvas is fastened to said wedge sections by screws extending into said wedge sections through grommets formed at each end of said canvas sheet.

10. A board as set forth in claim 9 wherein said board is angled at the end section proximate said wedge sections.

11. A board as set forth in claim 10 wherein said board is angled at the end opposite said wedge sections.

12. A board as set forth in claim 11 wherein said toehold is mounted to said angled section opposite said wedge sections.

* * * * *